US005685600A

United States Patent [19]

Kuo

[11] Patent Number: 5,685,600

[45] Date of Patent: Nov. 11, 1997

[54] COMBINED TABLE AND CHAIR ASSEMBLY

[75] Inventor: Hui-Kuei Kuo, Kaohsiung, Taiwan

[73] Assignee: Lin-Bing Liang, Kaohsiung, Taiwan

[21] Appl. No.: 641,575

[22] Filed: May 1, 1996

[51] Int. Cl.[6] ..... A47B 39/00

[52] U.S. Cl. ..... 297/157.1; 297/143; 297/158.3

[58] Field of Search ..... 297/143, 157.1, 297/158.2, 188.1, 246, 257, 158.3, 344.1, 140

[56] References Cited

U.S. PATENT DOCUMENTS

| | | | |
|---|---|---|---|
| 784,604 | 3/1905 | Wall | 297/143 |
| 1,314,240 | 8/1919 | Besner et al. | 297/143 |
| 1,339,669 | 5/1920 | Rapp | 297/143 |
| 2,244,531 | 6/1941 | Elder | 297/157.1 X |
| 2,956,617 | 10/1960 | Bruderer et al. | 297/143 X |
| 3,663,082 | 5/1972 | Geddes | 297/158.3 X |

FOREIGN PATENT DOCUMENTS

| | | | |
|---|---|---|---|
| 918154 | 1/1947 | France | 297/143 |

*Primary Examiner*—Laurie K. Cranmer

*Attorney, Agent, or Firm*—Bacon & Thomas

[57] ABSTRACT

A combined table and chair assembly includes a base, a table and two chairs. The base is formed as a rectangular frame with a pair of parallel side bars and a pair of transverse end bars which bridge two ends of the side bars. The table has a leg portion mounted securely on an intermediate portion of the base, and a table top mounted on a top end of the leg portion. The table top has a hollow bottom part which defines a first receiving space, and a flat top part which covers the first receiving space. The two chairs are mounted slidably on the base at opposite sides of the table. Each of the chairs has a hollow lower portion which defines a second receiving space, and a seat panel mounted turnably on an open top end of the hollow lower portion. The seat panel is turnable between a first position to close the second receiving space and a second position to access the second receiving space.

3 Claims, 5 Drawing Sheets

COMBINED TABLE AND CHAIR ASSEMBLY

BACKGROUND OF THE INVENTION

1. Field of the Invention

The invention relates to a table and chair assembly, more particularly to a combined table and chair assembly which can be used in different ways and which can be readily contracted so that space can be saved efficiently.

2. Description of the Related Art

Conventional tables and chairs are usually formed as separate pieces and has a disorderly appearance when not in use. Therefore, there is always a need to provide a table and chair assembly which can be readily contracted when not in use so that space can be saved efficiently.

SUMMARY OF THE INVENTION

The object of the present invention is to provide a combined table and chair assembly which can be used in different ways and which can be readily contracted so that space can be saved efficiently.

Accordingly, the combined table and chair assembly of the present invention comprises a base, a table and two chairs. The base is formed as a rectangular frame with a pair of parallel side bars and a pair of transverse end bars which bridge two ends of the side bars. The table has a leg portion mounted securely on an intermediate portion of the base, and a table top mounted on a top end of the leg portion. The table top has a hollow bottom part which defines a first receiving space, and a flat top part which covers the first receiving space. The two chairs are mounted slidably on the base at opposite sides of the table. Each of the chairs has a hollow lower portion which defines a second receiving space, and a seat panel mounted turnably on an open top end of the hollow lower portion. The seat panel is turnable between a first position to close the second receiving space and a second position to access the second receiving space.

Preferably, the flat top part of the table top includes a spaced pair of side panels fixed to the hollow bottom part of the table top, and at least one folding panel disposed between the side panels. The folding panel is mounted pivotally to an adjacent one of the side panels and is turnable between a first position to close the first receiving space and a second position to access the first receiving space.

In the disclosed embodiment, each of the side bars has an outer side formed with at least one longitudinally extending slide groove, and the hollow lower portion of each of the chairs has opposed side walls, at least one of which has an inner face that is provided with a rail projection which is received in the slide groove in an adjacent one of the side bars, thereby mounting slidably the chairs on the base.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
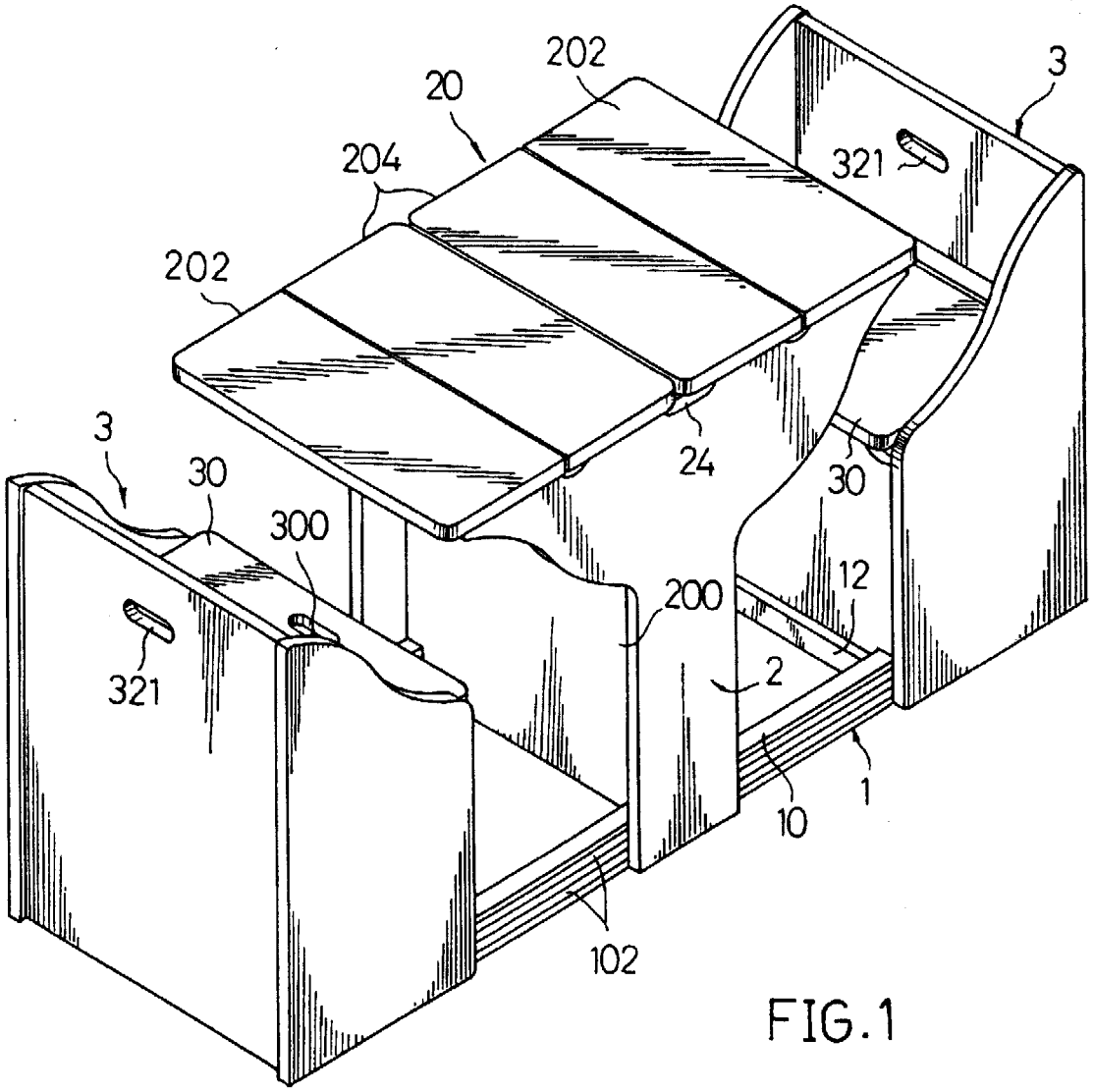
FIG. 1 is a perspective view of the preferred embodiment of a combined table and chair assembly according to the present invention.
Figure 2:
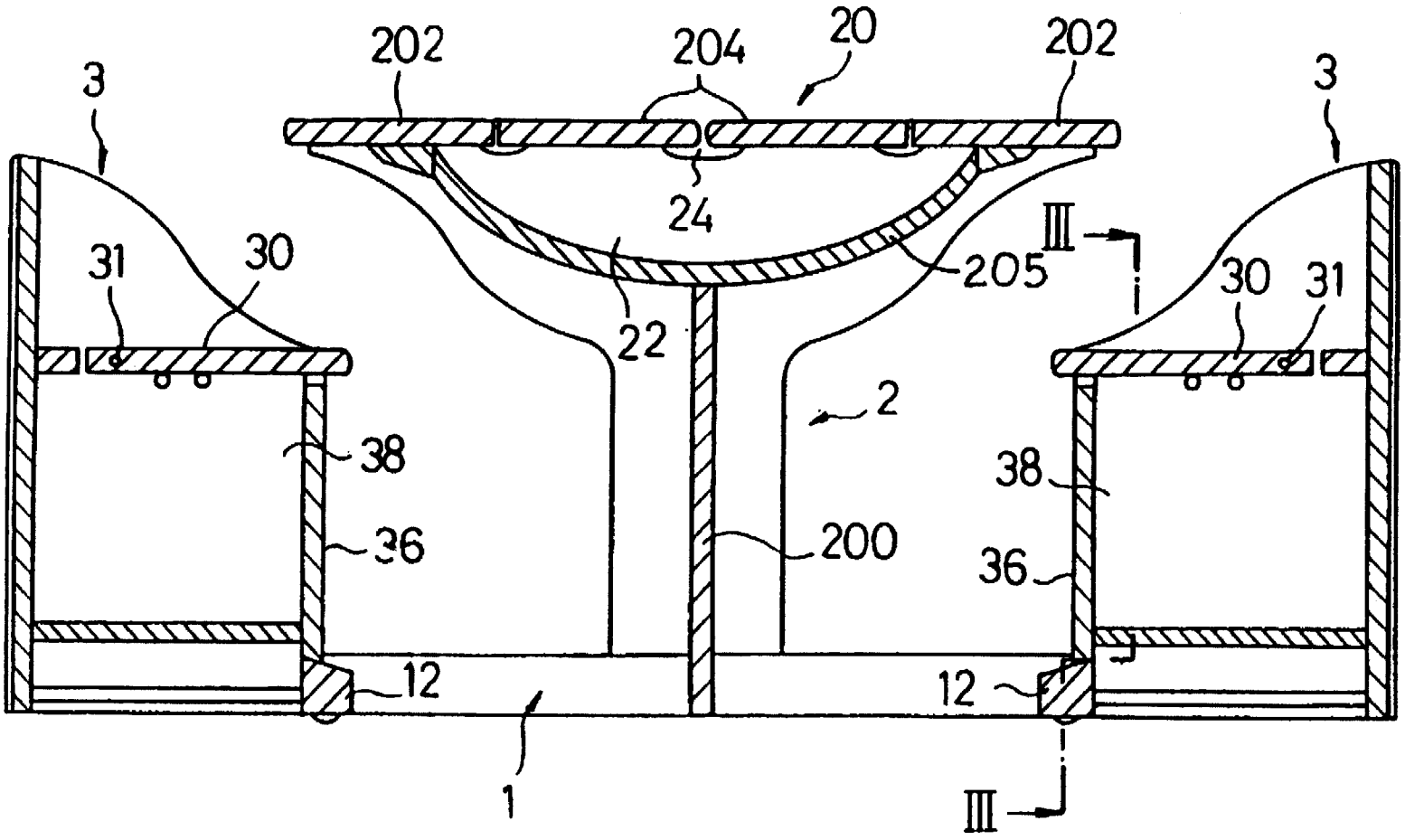
FIG. 2 is a sectional view of the preferred embodiment when in a fully extended position.

Referring to FIGS. 1 and 2, the preferred embodiment of a combined table and chair assembly according to the present invention is shown to comprise a base 1, a table 2 mounted securely on an intermediate portion of the base 1, and a pair of chairs 3 mounted slidably on the base 1 at opposite sides of the table 2.

The base 1 includes a pair of parallel side bars 10 and a pair of transverse end bars 12 bridging two ends of the side bars 10, thereby forming a rectangular frame 10. Each of the side bars 10 has an outer side formed with a plurality of longitudinally extending slide grooves 102 disposed at different heights.

The table 2 has a leg portion 200 mounted securely on the base 1, and a table top 20 mounted on a top end of the leg portion 200. The table top 20 has a hollow bottom part 205 which defines a receiving space 22, and a flat top part which covers the receiving space 22. The flat top part includes a pair of side panels 202 which are fixed to the hollow bottom part of the table top 20 and a pair of folding panels 204 disposed between the side panels 202 and mounted pivotally and respectively to the side panels 202. Thus, the receiving space 22 can be accessed by swinging the folding panels 204 upwardly relative to the side panels 202. The hollow bottom part of the table top 20 further has a top edge formed with recesses 24 to facilitate swinging of the folding panels 204.

Each of the chairs 3 has a hollow lower portion which defines a receiving space 38. A seat panel 30 is mounted pivotally on an open top end of the hollow lower portion by means of a pin 31 to permit accessing of the receiving space 38. In this embodiment, the seat panel 30 is formed with a through hole 300 in a front end thereof to facilitate swinging of the seat panel 30. Each of the chairs 3 further has a backrest with a top section that is formed with a through hole 321 to facilitate sliding movement of the chairs 3 relative to the table 2. As shown in FIG. 2, the hollow lower portion of each chair 3 has a front wall 36 with a bottom face that engages slidably the top face of a respective one of the end bars 12 when the chairs 3 are in the fully extended positions. Preferably, the bottom face of the front wall 36 and the top face of the end bar 12 are slanted to limit movement of the chairs 3 away from the table 2 and to minimize friction between the chairs 3 and the base 1.

Figure 3:
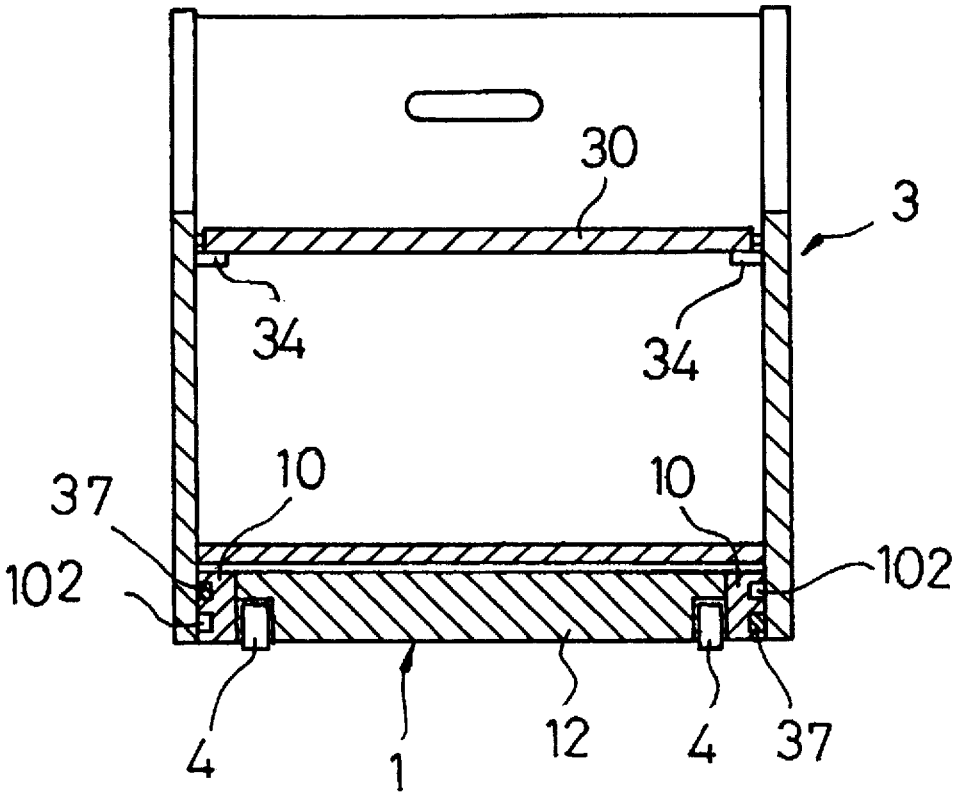
FIG. 3 is a sectional view of the preferred embodiment, taken along line III—III in FIG. 2, to illustrate the structural relationship between a chair and a base of the preferred embodiment.

Referring to FIG. 3, each of the end bars 12 is preferably provided with a pair of rollers 4 to facilitate movement of the entire assembly to a selected location. In addition, the hollow lower portion of each chair 3 has a pair of side walls, each of which has an inner face that is provided with a horizontally extending rail projection 37 which engages slidably one of the slide grooves 102 in a respective one of the side bars 10. Preferably, the rail projections 37 on each chair 3 are disposed at different heights to engage corresponding slide grooves 102 that are at different heights so as to ensure smooth and stable sliding movement of the chairs 3 along the base 1. Moreover, the side walls of each chair 3 are further provided with a plurality of reinforcing pins 34 which support the seat panel 30 thereon to increase the load bearing capacity of the latter.

Figure 4:
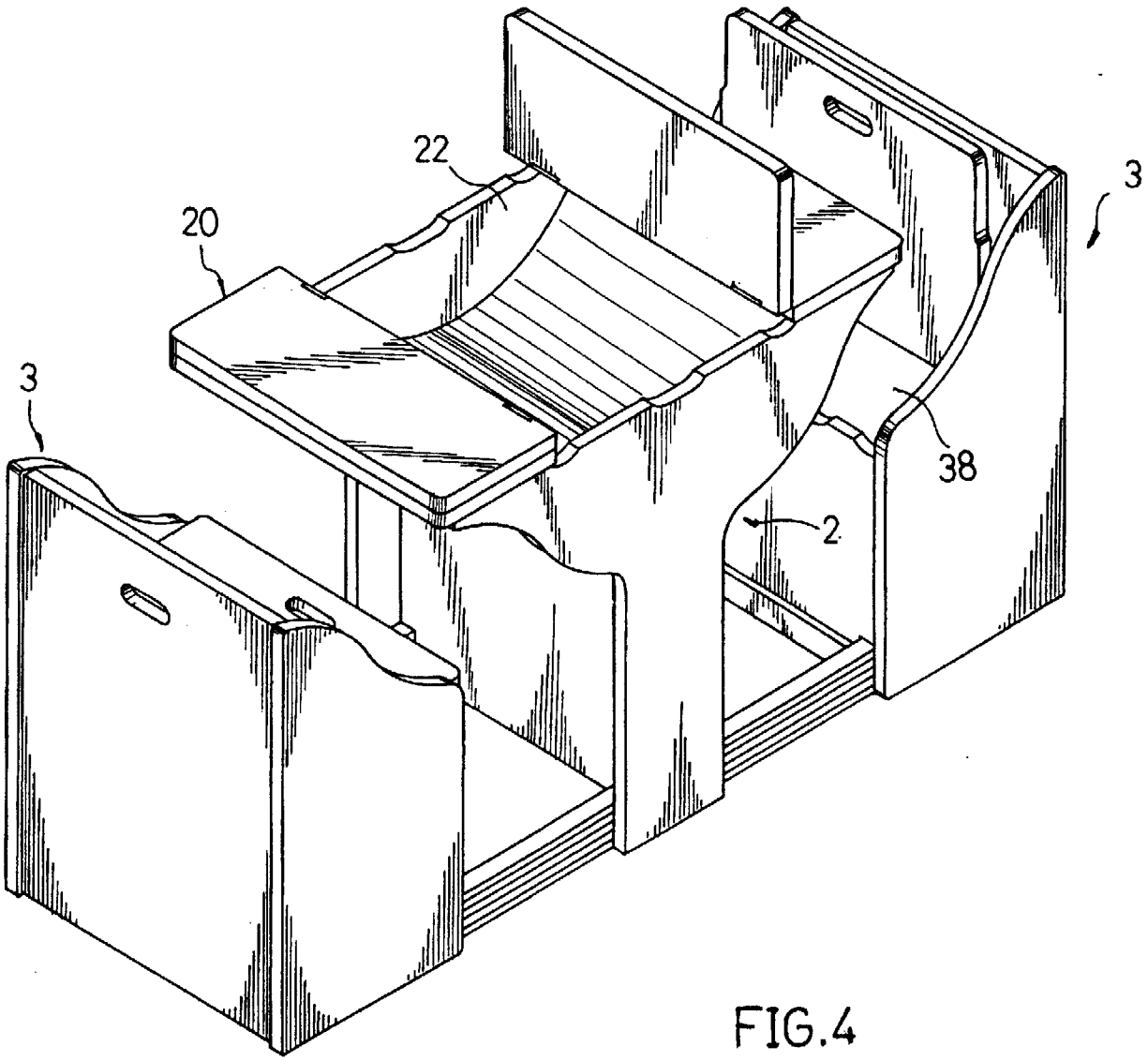
FIG. 4 is a perspective view of the preferred embodiment, illustrating folding panels of a table and a chair thereof when in an open position.

Referring to FIG. 4, in use, the chairs 3 are pulled away from the table 2 to enable a child to be seated on one of the chairs 3. The folding panels 204 can be swung open to access the receiving space 22, thereby permitting the placing of small objects, such as toys and writing tools, therein. In addition, the seat panel 30 can be swung open to access the receiving space 38, thereby permitting the placing of relatively large objects, such as stuffed toys, therein.

Figure 5:
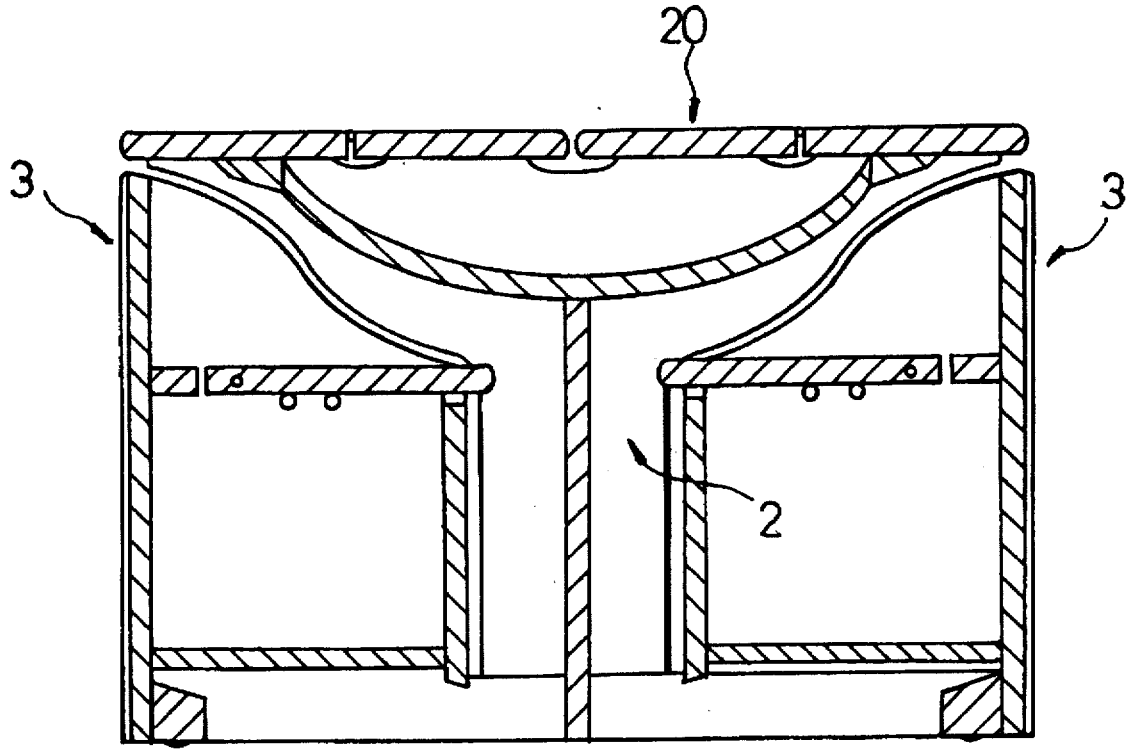
FIG. 5 is a sectional view of the preferred embodiment when in a contracted position.

Referring to FIG. 5, when the assembly of the present invention is not in use, the chairs 3 can be pushed toward the table 2, thereby causing the chairs 3 to slide into the corresponding space below the table top 20. Since the chairs 3 are mostly concealed by the table 2, thus resulting in a smaller rectangular block structure, the assembly of the present invention has an orderly appearance when not in use.

The advantages and characterizing features of the combined table and chair assembly of the present invention are as follows:

1. The chairs 3 are slidable along the base 1 between extended and contracted positions. In addition, the distances between the chairs 3 and the table 2 can be adjusted to suit the body dimensions of the user.
2. The present invention, which has the functions of a conventional table and chair, is further capable of storing objects therein due to the provision of the receiving spaces 22, 38. In addition, the present invention can be used as a small cabinet when in the retracted position.
3. The base 1 is provided with rollers 4 which facilitate sliding movement of the entire assembly to a desired location.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A combined table and chair assembly, comprising:

a base having a pair of parallel side bars:

a table having a leg mounted securely on an intermediate portion of said base, and a table top mounted on a top end of said leg, said table top having a hollow bottom part which defines a first receiving space, and a flat top part which covers said first receiving space wherein said flat top part includes first and second spaced apart, substantially horizontal side panels immovably fixed to said bottom part of said table top and spaced apart so as to provide an opening between said first and second side panels communicating with the first receiving space to provide access to the first receiving space through the table top, and first and second folding panels, each folding panel pivotally connected to one of said side panels so as to be movable between a first position wherein it covers said opening to close the first receiving space, and a second position wherein the opening is uncovered to provide access to the first receiving space through the table top; and two chairs mounted slidable and supported solely on said pair of side bars of said base at opposite sides of said table adjacent to said side panels, each of said chairs having a hollow lower portion which defines a second receiving space, and a seat panel pivotally mounted on said lower portions over an open top end of each of said hollow lower portions, each of said seat panels being movable between a first position to close the second receiving space and a second position to open and provide access to the second receiving space.

2. The combined table and chair assembly as claimed in claim 1, wherein:

each of said side bars has an outer side formed with at least one longitudinally extending slide groove; and said hollow lower portion of each of said chairs has opposed side walls, at least one of which has an inner face provided with a rail projection received in said slide groove in an adjacent one of said side bars, thereby slidably mounting said chairs on said base.

3. The combined table and chair assembly as claimed in claim 1, wherein said base has a pair of transverse end bars between ends of said side bars, and wherein said hollow lower portion of each of said chairs has a front wall with a lower portion that engages one of said end bars when said chair is in a farthermost position away from said table to limit movement of said chair in a direction away from said table.

* * * * *